US005991424A

United States Patent [19]

Bertagni et al.

[11] Patent Number: 5,991,424

[45] **Date of Patent: *Nov. 23, 1999**

[54] PLANAR DIAPHRAGM SPEAKER WITH HEAT DISSIPATOR

[75] Inventors: Alejandro Bertagni, Lake Forest; Eduardo Bertagni, Tustin, both of Calif.

[73] Assignee: Sound Advance Systems, Inc., Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/959,289

[22] Filed: Oct. 24, 1997

Related U.S. Application Data

[63] Continuation of application No. 08/430,416, Apr. 28, 1995, abandoned.

[51] Int. Cl.[6] ..... H04R 25/00

[52] U.S. Cl. ..... 381/397; 381/431

[58] Field of Search ..... 381/203, 194, 381/201, 397, 423, 431

[56] References Cited

U.S. PATENT DOCUMENTS

| | | | |
|---|---|---|---|
| 3,046,362 | 7/1962 | White . | |
| 3,596,733 | 12/1969 | Bertagni . | |
| 3,722,617 | 3/1973 | Bertagni . | |
| 3,767,005 | 10/1973 | Bertagni . | |
| 3,779,336 | 12/1973 | Bertagni . | |
| 3,792,394 | 2/1974 | Bertagni . | |
| 3,801,943 | 4/1974 | Bertagni . | |
| 3,991,286 | 11/1976 | Henricksen . | |
| 4,003,449 | 1/1977 | Bertagni . | |
| 4,017,694 | 4/1977 | King . | |
| 4,138,593 | 2/1979 | Hasselbach et al. . | |
| 4,184,563 | 1/1980 | Bertagni . | |
| 4,257,325 | 3/1981 | Bertagni . | |
| 4,328,400 | 5/1982 | Shimada et al. . | |
| 4,413,160 | 11/1983 | Ohyaba et al. . | |
| 4,837,838 | 6/1989 | Thigpen et al. | 381/192 |
| 4,850,023 | 7/1989 | Yarush | 381/67 |
| 4,928,312 | 5/1990 | Hill . | |
| 4,933,975 | 6/1990 | Button . | |
| 4,997,058 | 3/1991 | Bertagni . | |
| 5,005,556 | 4/1991 | Astle, Jr. | 126/110 R |
| 5,007,707 | 4/1991 | Bertagni . | |
| 5,045,659 | 9/1991 | Wolfe et al. | 219/10.55 E |
| 5,425,107 | 6/1995 | Bertagni et al. . | |

*Primary Examiner*—Sinh Tran

*Attorney, Agent, or Firm*—Sheppard, Mullin, Richter & Hampton LLP

[57] ABSTRACT

An improved planar diaphragm loudspeaker having a voice coil assembly coupled to the rear surface of a planar diaphragm formed of a pre-expanded cellular plastic material, in which a metal dissipator in the form of a disk is mounted between the voice coil assembly and the planar diaphragm to reduce the transfer of heat from the voice coil assembly to the planar diaphragm.

16 Claims, 3 Drawing Sheets

FIG. 5
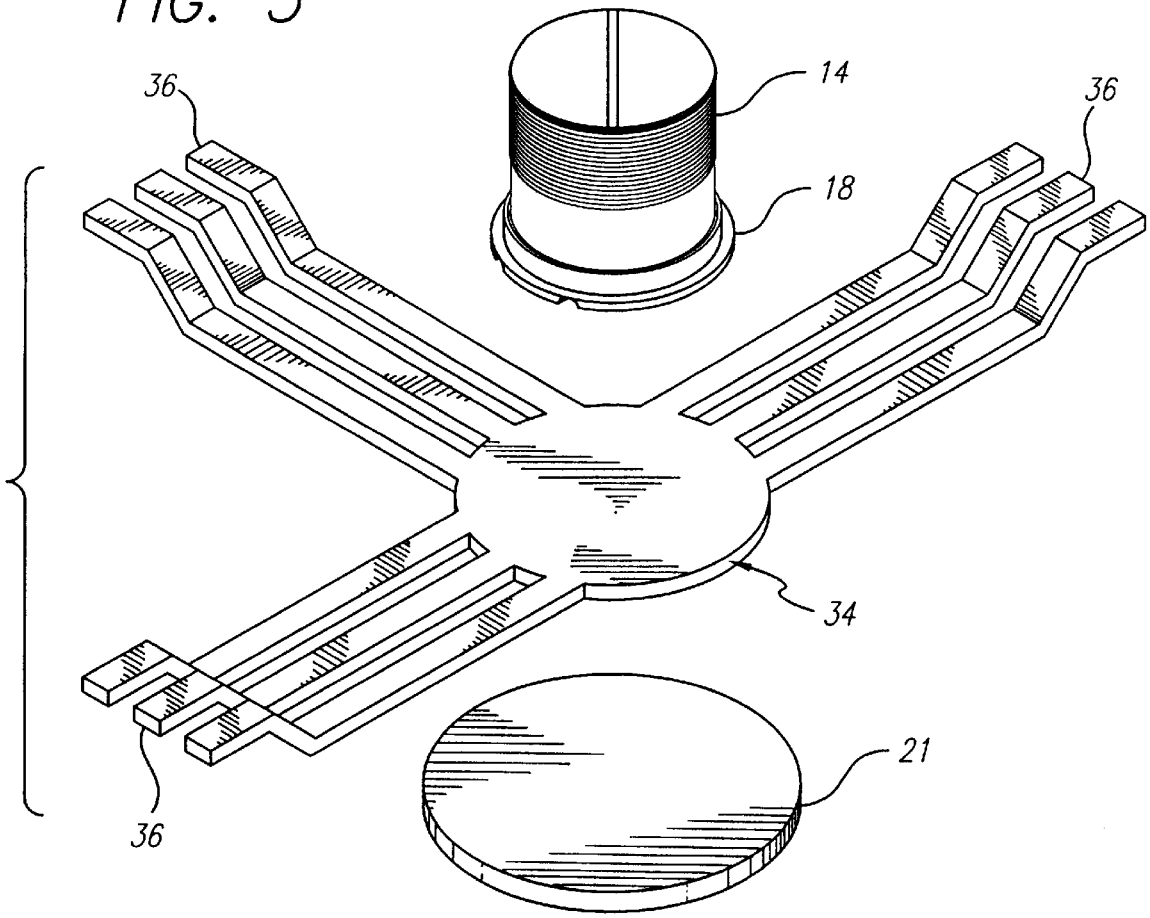
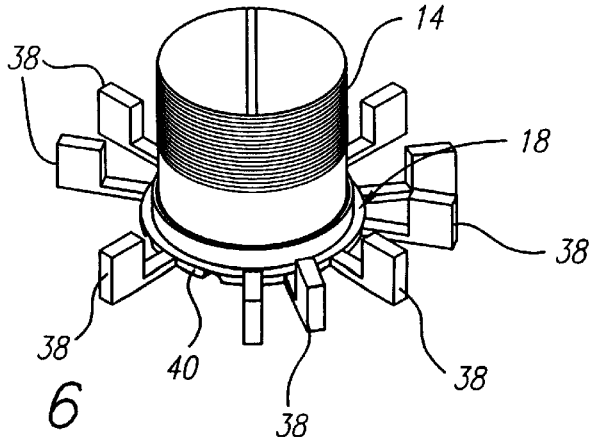
FIG. 6

PLANAR DIAPHRAGM SPEAKER WITH HEAT DISSIPATOR

This application is a continuation of application Ser. No. 08/430,416, filed Apr. 28, 1995, now abandoned.

BACKGROUND OF THE INVENTION

The present invention relates generally to loudspeakers, and, more particularly, to an improvement in planar-type loudspeakers utilizing a substantially flat diaphragm.

In recent years, certain advances in dynamic loudspeaker design have been provided by the advent of planar diaphragm loudspeakers. Such loudspeakers utilize a relatively stiff and substantially planar (or flat) diaphragm supported by a frame. A voice coil assembly or electromagnetic driver is coupled to the rear surface of the diaphragm. The voice coil or driver acts like a piston, pressing on a circular plate called a hammer, which, in turn, vibrates the diaphragm to produce sound. Typically, the planar diaphragm is constructed of a pre-expanded cellular plastic material, such as polystyrene or styrofoam. The frequency response of a planar diaphragm generally is determined by the type and density of its material, and the area, thickness and contour of its sound producing region. An example of such a planar diaphragm loudspeaker is shown and described in U.S. patent application Ser. No. 08/153,925, filed Nov. 18, 1993 in the name of Alejandro Bertagni et al., which is incorporated herein by reference. Other examples of planar diaphragm loudspeakers are shown and described in U.S. Pat. Nos. 4,003,449 and 4,997,058, both issued in the name of Jose J. Bertagni.

When electric signals are passed through the voice coil assembly, it vibrates the hammer and the diaphragm to produce sound. While the voice coil provides the vibrations necessary to generate sound, it also generates heat as a byproduct. Because the voice coil is coupled to the planar diaphragm, the heat from the voice coil can be conducted to and damage the planar diaphragm. In particular, it has been found that if the amount of heat conducted to the planar diaphragm causes its temperature to rise above approximately 85 degrees celsius, the diaphragm will cavitate or melt and the speaker will fail.

One attempt to avoid heat damage to the diaphragm material was to insert an insulating material, such as a combination of cork and neoprene, in the form of a disk between the hammer and the diaphragm. This insulating disk would act as a heat barrier or insulator to slow down the conduction of heat to the diaphragm. However, if the output power of the voice coil assembly was maintained or increased, the heat would rise sufficiently to cause failure of the diaphragm.

Accordingly, there exists a need for a planar diaphragm loudspeaker that conveys a reduced amount of heat through the coupling between its voice coil assembly and its planar diaphragm. The present invention fulfills this need.

SUMMARY OF THE INVENTION

Briefly, and in general terms, the present invention resides in a planar diaphragm loudspeaker that incorporates a metal heat dissipator mounted between the voice coil assembly and the planar diaphragm to reduce the amount of heat that is conveyed through the coupling between its voice coil assembly and the planar diaphragm. Thus, the planar diaphragm of the loudspeaker is less likely to fail by melting from heat generated by the voice coil assembly. Accordingly, the loudspeaker of the invention is more reliable and durable than conventional planar diaphragm loudspeakers.

Because the dissipator is mounted between the voice coil assembly and the planar diaphragm, the dissipator diffuses heat that would otherwise be conducted to the planar diaphragm. Thus, the dissipator advantageously reduces the transfer of heat from the voice coil assembly to the planar diaphragm. Therefore, the improved planar diaphragm speaker of the present invention is less likely to fail due to diaphragm melt down.

More specifically, and by way of example only, the dissipator may be a metal disk mounted between the hammer of the voice coil assembly and the planar diaphragm. Such a disk is inexpensive to manufacture and is easily installed during the production process. The disk has an area greater than that of the hammer, or the dissipator may have an expanded metal structure with an area substantially larger than the hammer for even greater heat dissipation. In a further aspect of the invention, the expanded metal structure of the dissipator may include radially-extending fins or propeller-like blades to diffuse heat from the voice coil assembly. Alternatively, the metal dissipator in any of these forms may be mounted between the voice coil assembly and the hammer to dissipate the heat directly at the voice coil.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The following drawings illustrate various embodiments of the invention, in which:

FIG. 5 is an exploded perspective view showing a dissipator in accordance with a fourth embodiment of the invention;

FIG. 6 is a perspective view showing a dissipator in accordance with a fifth embodiment of the invention.

DETAILED DESCRIPTION OF THE PREFERRED EMBODIMENTS

Figure 1:
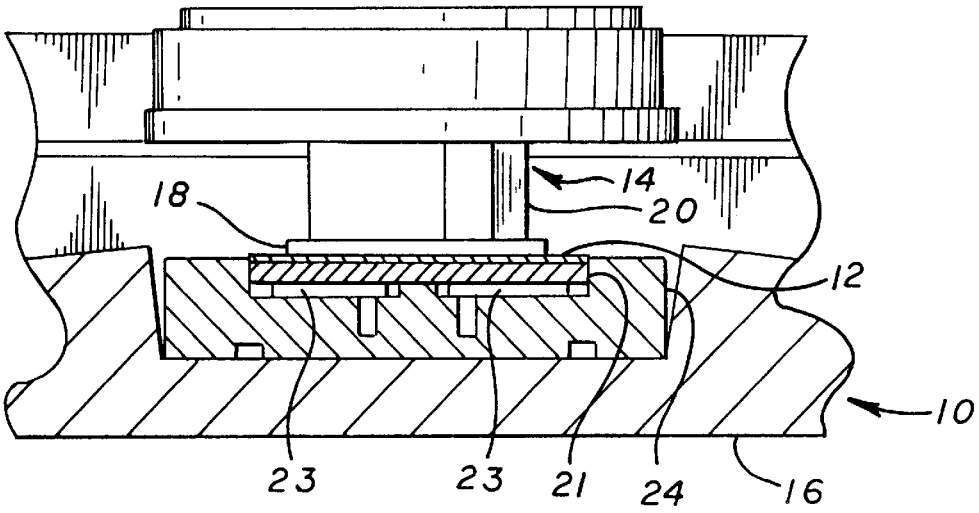
FIG. 1 is a fragmented elevational view, shown in partial cross-section, of an improved planar diaphragm loudspeaker in accordance with a first embodiment of the present invention.
Figure 2:
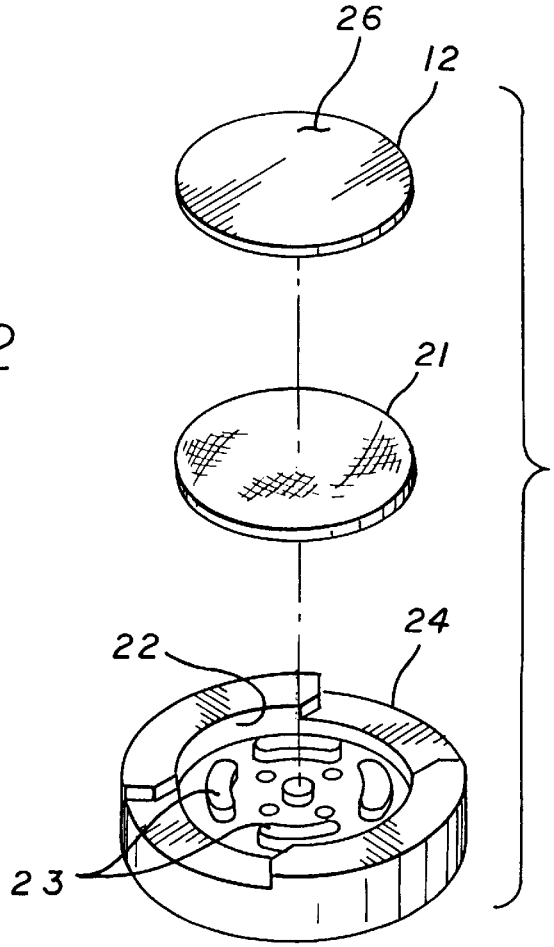
FIG. 2 is a perspective view of a dissipator, an insulator disk and a coupling disk of the planar diaphragm loudspeaker shown in FIG. 1.

Referring now to the drawings, and particularly to FIGS. 1 and 2 thereof, the present invention is embodied in an improved planar diaphragm loudspeaker, generally referred to by the reference numeral 10. The improved planar diaphragm loudspeaker has a dissipator 12 mounted between a voice coil assembly 14 and a planar diaphragm 16. The dissipator advantageously diffuses heat that would otherwise be conducted to the planar diaphragm.

As shown in FIGS. 1 and 2, a disk-shaped hammer 18 is mounted to an output end 20 of the voice coil assembly 14. The dissipator 12 is mounted adjacent to the hammer and is itself mounted to an insulator disk 21 located in a circular recess 22 formed in a coupling disk 24 attached to the planar diaphragm.

The dissipator 12 has the shape of a disk and is made of 0.025 inch thick aluminum. The diameter of the dissipator is larger than that of the hammer 18 to provide an area suitable for dissipating heat through radiation and convection. A surface 26 of the dissipator that abuts the hammer is anodized to provide an increased surface area well suited to conduct some heat away from the hammer and dissipate it into air inside the loudspeaker before that heat can reach the planar diaphragm. The anodized surface could be colored black to radiate more heat away from the dissipator. The anodized surface also is electrically nonconductive to insulate the dissipator from the hammer, which may have electrodes (not shown) that could short from contact with the dissipator. It should be appreciated that any material having the ability to transfer heat at a high rate can be used for the dissipator, including aluminum, plastics, steel and other materials well known in the art. Further, the mass of the dissipator affects the performance of the loudspeaker, as is well known in the art.

The insulator disk 21 is approximately the same diameter as the dissipator 12 and is made of a combination of cork and neoprene or a material sold under the name PYROPEL by the Albany International Research Company of Mansfield, Mass. The insulator disk acts as a known insulator or heat barrier to slow down heat transmission to the coupling disk 24 and planar diaphragm 16.

The insulator disk 21 is adhered within the circular recess 22 in the coupling disk 24 by adhesive. Preferably a number of pins or lands 23 of specified height are formed in the recess to accommodate a uniform thickness of adhesive. In the example shown in FIG. 2, a 0.015 inch thick layer of No. 734 RTV SEALANT brand silicon rubber sealant, sold by the Dow-Corning Corporation of Midland, Mich., is utilized to affix the insulator disk to the coupling disk. The coupling disk, in turn, is affixed to the planar diaphragm 16 by a 0.030 inch thick layer of epoxy adhesive sold under the name DP100NS by the Minnesota Mining and Manufacturing Co., located in St. Paul, Minn.

Similarly, a 0.063 inch thick layer of No. 732 RTV SEALANT brand silicone rubber sealant is used to affix the hammer 18 to the dissipator 12. A 0.015 inch thick layer of No. 732 RTV SEALANT brand silicone rubber sealant is utilized to affix the dissipator to the insulator disk 20. With regard to the adhesives and sealants, it should be appreciated that changes in materials and the thicknesses of the layers can be made to meet the frequency response requirements of a specific application.

The resiliency of the silicon sealants used influence the performance of the loudspeaker. If a more resilient silicon sealant is used, the loudspeaker will be less efficient at reproducing high frequency sounds. The opposite is true if a less resilient silicon sealant is used.

Figure 3:
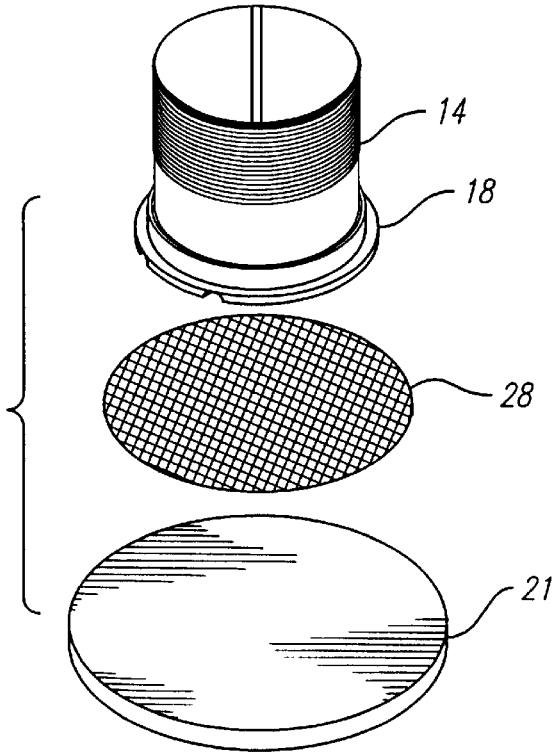
FIG. 3 is an exploded perspective view showing a dissipator in accordance with a second embodiment of the invention.

The thickness and shape of the dissipator will vary with the power handling requirements of a particular loudspeaker. Several alternative dissipators are shown in FIGS. 3 through 6. In FIG. 3, an expanded metal dissipator 28 is shown for mounting between the hammer 18 and the insulator disk 21. The expanded metal dissipator is formed by a well known process that includes cutting aligned slits in a metal blank and stretching the metal blank in a direction perpendicular to the slits to form a mesh-like dissipator. The expanded metal dissipator has a greater surface area than the disk-shaped dissipator, resulting in more heat dissipation. The silicone sealant also can penetrate the slits of the expanded metal dissipator to better hold it to the hammer and insulator disk.

Figure 4:
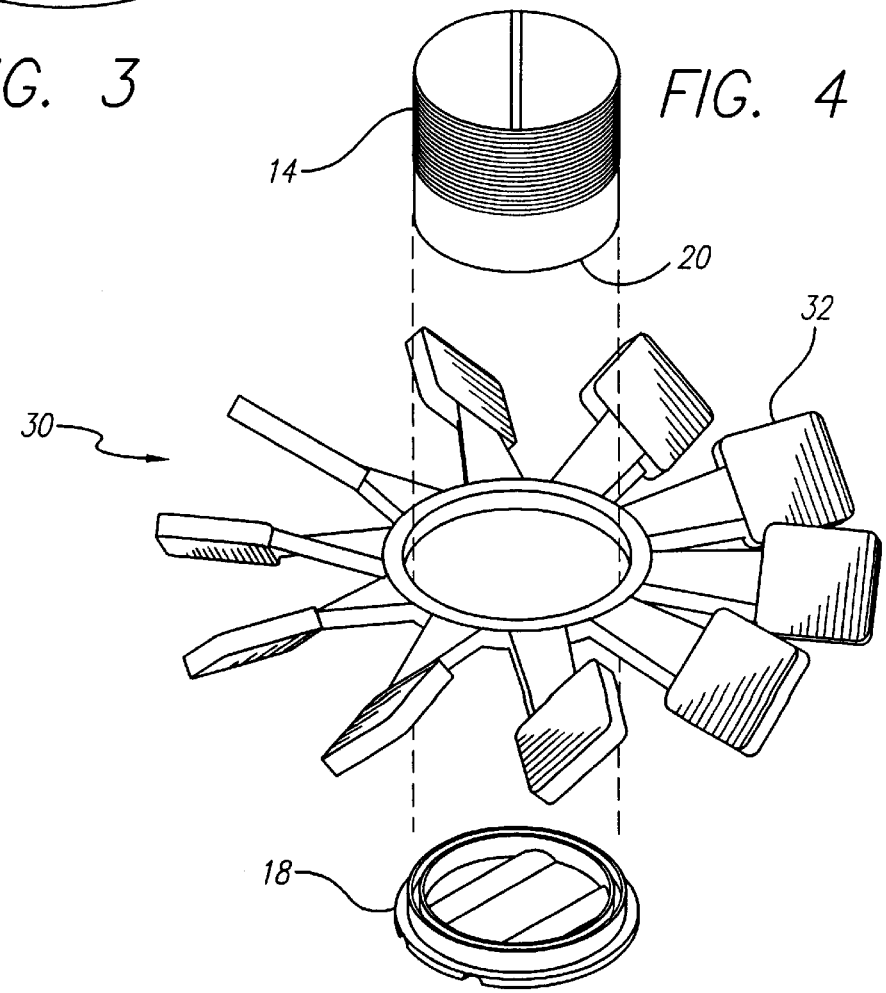
FIG. 4 is an exploded perspective view showing a dissipator in accordance with a third embodiment of the invention.

FIG. 4 shows an alternative design comprising a dissipator 30 having propeller-like fins 32 that extend radially-outward. This dissipator can be mounted between the hammer 18 and the voice coil assembly 14 to reduce the amount of heat passing to the hammer and planar diaphragm from the voice coil assembly. As this dissipator vibrates, it creates air turbulence inside the loudspeaker to dissipate more heat from the propeller-shaped fins.

FIG. 5 shows another alternative design featuring a dissipator 34 having three sets of fins 36 extending radially outwardly to form a T shape. The dissipator of FIG. 5 is mounted between the hammer 18 and the insulator disk 21. FIG. 6 shows another alternative design comprising a dissipator 38 having several fins directly attached to a circumferential edge 40 of the hammer. These fins also extend radially outwardly and reduce the amount of heat transferred to the hammer from the voice coil assembly, thereby also reducing the amount of heat that eventually reaches the planar diaphragm.

In operation, all of the above-identified dissipators dissipate some of the heat originally generated by the voice coil assembly 14 to reduce the amount of heat that eventually reaches the planar diaphragm by conduction through the components coupling the voice coil and the planar diaphragm. Accordingly, because the planar diaphragm is less likely to overheat and melt, the improved planar diaphragm speaker is advantageously more reliable and durable, especially when high power is applied to the voice coil assembly.

It will, of course, be understood that modifications to the presently preferred embodiment will be apparent to those skilled in the art. Consequently, the scope of the present invention should not be limited by the particular embodiment discussed above, but should be defined only by the claims set forth below and equivalents thereof.

We claim:

1. In a planar diaphragm loudspeaker having a voice coil assembly coupled at one end to the rear surface of a planar diaphragm, wherein the voice coil assembly operates to vibrate the planar diaphragm and thereby produce sound, the improvement comprising a heat dissipator disposed between the voice coil assembly and the planar diaphragm, the heat dissipator mounted in contact with said one end of the voice coil assembly, with at least a portion of the heat dissipator directly exposed outside the voice coil assembly to ambient air at the rear surface of the planar diaphragm, in order to dissipate heat generated by the voice coil assembly and thereby inhibit the transfer of heat from the voice coil assembly to the planar diaphragm.

2. The improved planar diaphragm loudspeaker according to claim 1, wherein at least a portion of the heat dissipator extends substantially parallel to the rear surface of the planar diaphragm and beyond the boundary of said one end of the voice coil assembly to expose said portion of the heat dissipator to ambient air.

3. The improved planar diaphragm loudspeaker according to claim 1, and further including an insulator mounted between the heat dissipator and the planar diaphragm.

4. The improved planar diaphragm loudspeaker according to claim 3, wherein the heat dissipator is mounted in contact with both said one end of the voice coil assembly and the insulator.

5. The improved planar diaphragm loudspeaker according to claim 3, and further including a coupling disk mounted between the insulator and the planar diaphragm.

6. In a planar diaphragm loudspeaker having a voice coil assembly coupled at one end to the rear surface of a planar diaphragm, wherein the voice coil assembly operates to vibrate the planar diaphragm and thereby produce sound, the improvement comprising a heat dissipator mounted between said one end of the voice coil assembly and the planar diaphragm, wherein the heat dissipator includes at least two oppositely-facing heat dissipating surfaces each of which are directly exposed outside the voice coil assembly to ambient air at the rear surface of the planar diaphragm.

7. The improved planar diaphragm loudspeaker according to claim 6, wherein at least one of the heat dissipating surfaces generally faces the rear surface of the planar diaphragm and at least one of the heat dissipating surfaces generally faces away from the rear surface of the planar diaphragm.

8. The improved planar diaphragm loudspeaker according to claim 6, wherein the heat dissipating surfaces comprise the opposite sides of a heat dissipating fin extending outwardly away from the voice coil assembly.

9. In a planar diaphragm loudspeaker having a voice coil assembly including a hammer disposed between one end of the voice coil assembly and a rear surface of a planar diaphragm formed of a pre-expanded cellular plastic material, wherein the hammer is driven by the voice coil assembly to vibrate the planar diaphragm, the improvement comprising a heat dissipator disposed between the hammer and the planar diaphragm, at least a portion of the heat dissipator extending beyond the boundary of the hammer for direct exposure outside the voice coil assembly to ambient air at the rear surface of the planar diaphragm in order to dissipate heat generated by the voice coil assembly, whereby the transfer of heat through the hammer from the voice coil assembly to the planar diaphragm is inhibited.

10. The improved planar diaphragm loudspeaker according to claim 9, wherein the heat dissipator is mounted in contact with an end surface of the hammer.

11. The improved planar diaphragm loudspeaker according to claim 10, wherein the heat dissipator is in the shape of a disk having a larger surface area than the end surface of the hammer.

12. The improved planar diaphragm loudspeaker according to claim 10, wherein the heat dissipator is formed of metal.

13. The improved planar diaphragm loudspeaker according to claim 12, wherein the heat dissipator is formed of aluminum.

14. The improved planar diaphragm loudspeaker according to claim 13, wherein the aluminum has an anodized finish.

15. The improved planar diaphragm loudspeaker according to claim 12, wherein the heat dissipator is formed of an expanded metal.

16. The improved planar diaphragm loudspeaker according to claim 10, wherein the dissipator has heat dissipating fins extending outwardly beyond the end surface of the hammer.

* * * * *